US012292050B1

(12) United States Patent
Popovac et al.

(10) Patent No.: US 12,292,050 B1
(45) Date of Patent: May 6, 2025

(54) VACUUM PUMP TO GENERATE A NEGATIVE PRESSURE

(71) Applicant: Gebr. Becker GmbH, Wuppertal (DE)

(72) Inventors: Denko Popovac, Cologne (DE); Michael Rapp, Solingen (DE)

(73) Assignee: Gebr. Becker GmbH, Wuppertal (DE)

( * ) Notice: Subject to any disclaimer, the term of this patent is extended or adjusted under 35 U.S.C. 154(b) by 0 days.

(21) Appl. No.: 18/619,540

(22) Filed: Mar. 28, 2024

(51) Int. Cl.
*F04C 2/356* (2006.01)
*F04C 15/06* (2006.01)

(52) U.S. Cl.
CPC ..... *F04C 2/3568* (2013.01); *F04C 15/06* (2013.01); *F04C 2240/30* (2013.01); *F04C 2240/40* (2013.01)

(58) Field of Classification Search
CPC .... F04C 2/3568; F04C 15/06; F04C 2240/30; F04C 2240/40
See application file for complete search history.

(56) References Cited

U.S. PATENT DOCUMENTS 5,100,308 A * 3/1992 Gevelhoff ..... F01C 21/104 418/152
10,113,548 B2 * 10/2018 Rapp ..... F04C 29/124
2004/0170516 A1 * 9/2004 Hinchey, Jr. ..... F04C 29/065 418/181
2018/0142554 A1 * 5/2018 Kraft ..... F04C 25/02

FOREIGN PATENT DOCUMENTS

| | | | |
|---|---|---|---|
| DE | 89 08 757 | U1 | 9/1989 |
| DE | 44 24 629 | C1 | 3/1995 |
| DE | 198 18 667 | A1 | 10/1999 |
| DE | 101 06 111 | A1 | 8/2002 |
| DE | 103 30 541 | A1 | 2/2005 |

* cited by examiner

*Primary Examiner* — J. Todd Newton
(74) *Attorney, Agent, or Firm* — Collard & Roe, P.C.

(57) ABSTRACT

A vacuum pump for generating a negative pressure includes a pump housing having a pump chamber with a rotor and a motor for driving the rotor with a drive shaft rotatable about a longitudinal axis, a first and a second inlet line. The second inlet line leads through the pump housing into the pump chamber. A first outlet line leads from the pump chamber through the pump housing. The pump has a first outlet valve and a second outlet line connected to the pump housing. A connecting part is attached to a connecting surface running circumferentially to the longitudinal axis, and the outlet valve with the second outlet line is formed in the connecting part. The connecting part further has the first inlet line, with a first connecting opening formed in the connecting part housing, via which the first inlet line is connected to the second inlet line.

17 Claims, 13 Drawing Sheets

1
3
2
L
8
4
7
6
63
39
XIII
XIII
24
24
25
28
59
50
24
49
27

VACUUM PUMP TO GENERATE A NEGATIVE PRESSURE

FIELD OF TECHNOLOGY

The invention initially relates to a vacuum pump for generating a negative pressure, comprising a pump housing having a pump chamber with a rotor and a motor for driving the rotor with a drive shaft rotatable about a longitudinal axis, further comprising a first and a second inlet line, wherein the second inlet line as a continuation of the first inlet line leads through the pump housing into the pump chamber, a first outlet line leading from the pump chamber through the pump housing, a first outlet valve, a second outlet line adjoining the pump housing, wherein further on the pump housing a connecting part housing is attached on a connecting surface running circumferentially to the longitudinal axis and the outlet valve with the second outlet line is formed in the connecting part.

The invention further relates to a vacuum pump with a pump housing in which a rotor, which is rotatable about a longitudinal axis, and a first outlet line are accommodated, further comprising a motor housing in which a motor with a drive shaft which runs axially in alignment with the longitudinal axis, is accommodated, and a connecting part with an outlet valve and a second outlet line.

STATE OF THE ART

Vacuum pumps of the type in question are known, for example in the form of rotary vane vacuum pumps, and also in the form of so-called side channel compressors.

Rotary vane vacuum pumps are usually blowers with a pump housing that forms a pump chamber, which pump chamber is preferably configured in the form of a cylindrical bore. The rotor is usually configured to be cylindrical, with sliders that are displaceably arranged in slots in the rotor. The slots in the rotor can be aligned strictly radially with respect to a cross-section through the rotor or can also run at an acute angle to a radial.

When the vacuum pump is in operation, the rotor rotates in a radially offset manner with respect to the central axis of the pump housing. This results in closed chambers, separated by the substantially radially displaceable sliders, the size of which changes during one revolution of the rotor. The size changes result in pressure differences between the individual chambers and thus between the inlet line and the outlet line.

Rotary vane vacuum pumps are known, for example, from DE 101 06 111 A1, furthermore from DE 103 305 41 A1 or also from DE 89 08 757 U1 (U.S. Pat. No. 5,100,308 A). Vacuum pumps in the form of side channel compressors are known, for example, from DE 198 18 667 A1 or DE 44 246 29 C1.

Furthermore, it is known to provide an outlet valve on the outlet side of the pump, behind which the conveyed medium can be blown out into the environment, for example, when the vacuum pump is configured as a suction device. In this regard, reference is made, for example, to U.S. Pat. No. 10,113,548 B2, from which it is further known to arrange the outlet valve with the second outlet line in a connecting part.

SUMMARY OF THE INVENTION

Starting from the prior art, such as that known from the said U.S. Pat. No. 10,113,548 B2, the object of the invention is to advantageously further develop a vacuum pump of the type in question.

According to a first inventive idea, a possible solution to the problem is given in a vacuum pump, in which it is intended that the connecting part further has the first inlet line, with a first connecting opening formed in the connecting part, via which the first inlet line is connected to the second inlet line.

As a result of the proposed configuration, an advantageous configuration of the vacuum pump is obtained. For this purpose, the connecting part has both the second outlet line with the outlet valve and the first inlet line. With regard to the inlet line to the pump chamber, the line interface is obtained in the area of the connecting surface between the pump housing and the connecting part housing.

The essential components or assemblies—viewed in the direction of flow—outside or upstream and downstream of the pump chamber are formed or arranged in the connecting part. This advantageously results in a modular structure which, for example, enables the gas inlet and gas outlet elements to be easily changed by replacing the connecting part.

The pump housing can therefore be provided with differently equipped connecting parts depending on the area of application.

A possible solution to the problem can also be given according to a further inventive idea in a vacuum pump, in which it is intended that in the usage state the pump housing is arranged vertically below the motor housing and the connecting part housing is arranged vertically below the pump housing.

As a result of such a configuration, an advantageous arrangement of the vacuum pump can be obtained. Particularly when there is little storage space available, a vertical arrangement of the vacuum pump as a whole can be achieved, in which the motor part housing, the pump housing and the connecting part housing are arranged in a tier-like position one above the other.

The connecting part housing is preferably the substantially lowest ele-ment of the vacuum pump-relative to the vertical usage position of the vacuum pump. An inflow and outflow of the gas to be conveyed into and out of the vacuum pump can thus be achieved facing the installation surface of the vacuum pump as a whole, possibly close to the installation surface.

A vacuum pump can be provided with a connecting part, which further has the first inlet line, with a first connecting opening formed in the connecting part housing, via which the first inlet line is connected to the second inlet line, wherein further in the usage state the pump housing is arranged vertically below the motor housing and the connecting part housing vertically below the pump housing.

Furthermore, it can be provided that the second outlet line is connected to the first outlet line via a second connecting opening formed in the connecting part housing. Accordingly, in the area of the connecting surface two interfaces formed by connecting openings can be obtained, via which the line sections in the connecting part housing are in fluidic communication with the other line sections in the pump housing in the usual usage position of the vacuum pump.

Substantially two-part inlet and outlet lines connected one behind the other in the flow direction can be obtained, one part of which extends on one side of the connecting surface formed between the connecting part housing and the pump housing and the other part extends on the other side of the connecting surface.

The connecting surface, which preferably has the two connecting openings for the inlet and outlet lines, can be formed in the manner of a flat interface. In an alternative configuration, the connecting openings can also be formed in different planes, for example offset in the axial direction of the drive shaft.

The first outlet valve, which according to a possible embodiment can in principle also be the only outlet valve, is preferably arranged in the second outlet line. This can further result in a preferred configuration of the second outlet line in the direction of flow upstream and/or downstream of the outlet valve.

The connecting part or the connecting part housing can also have one or more chambers. The one or more chambers can form lines or parts of lines and/or receptacles for, for example, the outlet valve, wherein in the case of an arrangement of several chambers, these may optionally be directly connected to one another in the usual usage state of the vacuum pump and can therefore merge into one another fluidically or when viewed in the direction of flow can only be indirectly connected to one another, for example, as is also preferred, via the pump chamber of the pump housing.

When forming a plurality of chambers, the first outlet valve can be arranged in a first chamber of the connecting part housing. This first chamber, which can at the same time at least partially form the second outlet line, can be formed downstream of the second connecting opening when viewed in the flow direction, correspondingly in an area downstream of the pump housing in the flow direction.

In a preferred further development, a filter can be provided on the inlet side. Such an inlet filter can, as is also preferred, be assigned to the first inlet line and thus further preferably also be part of the connecting part like the first inlet line, the second outlet line and the first outlet valve.

If several chambers are formed in the connecting part housing, the inlet filter can be arranged, for example, in a second chamber. This second chamber, which can at the same time at least partially form the first inlet line, can be formed upstream of the first connecting opening when viewed in the flow direction, correspondingly in an area upstream of the pump housing in the flow direction.

An outlet filter can also be provided in combination or alternatively. This can, as is preferred, be arranged in the area of the second outlet line in such a manner that gaseous medium which has previously passed through the outlet filter flows exclusively through the first outlet valve.

In this case, if several chambers are formed in the connecting part housing, the outlet filter can, for example, be arranged in a third chamber, as is preferred. This third chamber, which at the same time can also at least partially form the second outlet line, can be formed downstream of the second connecting opening and upstream of the first chamber with the first outlet valve when viewed in the direction of flow.

According to a preferred embodiment, the connecting surface of the pump housing can run substantially perpendicular to the longitudinal axis. This can result in a connecting plane directed transversely to the longitudinal axis.

The connecting part has a mating connecting surface. This is preferably aligned to run in the same direction as the connecting surface of the pump housing, correspondingly preferably in a plane transverse to the longitudinal axis.

In the usage position of the vacuum pump, the connecting surface and the mating connecting surface abut preferably and substantially flat against each other over the entire surface. A seal can also be provided between these connecting surfaces completely or only partially, but preferably circumferentially with respect to the longitudinal axis.

The first and/or second connecting opening is preferably (also) formed in the mating connecting surface. Flow transitions that are directed substantially in the direction of the longitudinal axis are also preferably obtained between the connecting part housing and the pump housing alone.

Both the medium inlet and the medium outlet of the vacuum pump as a whole are laid in the connecting part housing, wherein the connecting plane obtained between the connecting surface and the mating connecting surface is penetrated twice by the gaseous medium and in opposite directions.

The inlet filter and/or the outlet filter can have a circumferential filter wall through which flow can take place from the outside to the inside and which forms a flow path for a filtered medium on the inside. This can be, for example, a dry filter or, for example, a cartridge or pleated filter, which fre-quently has a tubular design. Flow through such filters generally takes place from radially outside to radially inside.

In a further embodiment, the inlet filter and the outlet filter can be arranged such that the flow paths of the inlet filter and the outlet filter run substantially at right angles to one another. In the case of a tubular design of the filters as is also preferred, the longitudinal axes of the filters can accordingly be aligned perpendicular to one another.

The first outlet valve can also then be connected in the direction of the inner flow path of the outlet filter.

In a further preferred embodiment, a fourth chamber can be connected to the first outlet valve which chamber is closed off to the outside by a second and a third outlet valve. The fourth chamber can form a collecting space into which the gaseous medium can flow after passing through the first outlet valve. The second and third outlet valves can form exhaust valves.

If three outlet valves are arranged, flow through all the outlet valves can take place in the same direction. The flow direction is the immediate direction that the gaseous medium basically takes on the way from an area in the flow direction upstream of the outlet valve to an area in the flow direction downstream of the outlet valve, in which case a flow direction along an imaginary straight line results from this.

The flow directions through all three outlet valves can, as is preferred, be in the same direction but spatially offset.

Alternatively, in the case of the arrangement of three outlet valves, the flow through the second and third outlet valves downstream of the first outlet valve in the flow direction can take place in a flow direction that is the same but perpendicular to a flow direction of the first outlet valve. Accordingly, a deflection of the gaseous medium by substantially 90 degrees can result in the fourth chamber or collecting chamber in the course of passing through the second and/or third outlet valve. Such a deflection can be advantageous, for example, when arranging the connecting part vertically below the pump housing, which pump housing is in turn provided vertically below the motor housing, in order to be able to achieve an outlet flow direction directed downwards in the direction of the installation surface even with such a vertical orientation of the vacuum pump.

In one embodiment, the fourth chamber can be partially formed by a wall of the connecting part housing, which is also a wall of the second chamber for receiving the inlet filter. The relevant housing wall section separates the second and fourth chambers from one another in a flow-tight manner.

The one or more outlet valves can be, for example, a mechanically oper-ated valve, furthermore for example, with a valve plate which can be moved in a linear direction from a blocking position into an open position and back, optionally spring-loaded, which cooperates with a valve seat.

An outlet valve can have a corresponding opening direction. As is preferred, this can be aligned along a straight line and, moreover, substantially cor-respond to the previously described idealized flow direction.

The one or more outlet valves can also be fastened interchangeably in or on the connecting part housing, for example as a result of a screw connection.

When viewed in the opening direction of the first outlet valve, in one possible embodiment, the first and second outlet valves can be arranged substantially in overlap with one another. This can result in an arrangement of the first and second exhaust valves one behind the other along an imaginary common axis. After the second outlet valve has been removed, in one possible embodiment, access to the first outlet valve can be achieved through the fourth chamber.

In a further embodiment, the second outlet valve can be accommodated in the connecting part by means of an installation part, which, viewed perpendicular to the opening direction, has a larger area than the first outlet valve. The installation part can be removably held in the receiving part housing, for example via a screw connection, wherein the installation part itself in turn has a fastening option for the second outlet valve, further for example a screw connection. The second outlet valve can thus be removed together with the installation part or one after the other from the receiving part housing, after which a suffi-ciently large opening is obtained in the receiving part housing to enable access to the first outlet valve. The first outlet valve can, if necessary, be dismounted and removed through the opening in the connecting part housing that is obtained after the installation part has been removed.

The fourth chamber can also have a non-uniform extension in relation to the first and possibly the second outlet valve in the transverse direction to the opening direction of the first and possibly the second outlet valve. The non-uniform extension can result, for example, from different heights of the fourth chamber when viewed in the opening direction of the first and possibly the second outlet valve.

The fourth chamber can further have a chamber floor, a chamber ceiling and a chamber side wall, wherein the first outlet valve is arranged in the chamber ceiling and the second outlet valve is arranged in the chamber floor.

Advantageously, in addition to the second outlet valve, the third outlet valve can also be arranged in the chamber floor, so that substantially and preferably a side-by-side arrangement of the second and third outlet valve can be provided.

Expelled gaseous medium, which leaves an open first outlet valve in the direction of the fourth chamber, can flow past the second outlet valve to the third outlet valve when the second outlet valve is closed, with the gas being diverted along the chamber floor. For example, the outlet gas can exit freely into the environment both only through the second or third outlet valve or, as is preferred, simultaneously through the two outlet valves on the chamber floor side.

A chamber side wall can be formed directly by the housing outer wall of the connecting part, just as the chamber floor can optionally directly form the housing floor. The chamber side wall preferably extends substantially in the opening direction of the first outlet valve, this in a more preferably circumferentially closed configuration—at least outside the mating connecting surface.

In addition, the third outlet valve can be arranged in the opening direction of the first and optionally the second outlet valve at the same distance in the opening direction to the first outlet valve as the second outlet valve to the first outlet valve. For example, the sealing seats of the second and third outlet valves defining the sealing plane can substantially extend in a common plane that runs substantially parallel to the chamber floor, which plane, when viewed in the opening direction, is at a distance from the sealing plane of the first outlet valve.

An inlet flow direction of the gaseous medium into the second chamber accommodating the inlet filter can be the same as an outlet flow direction from the fourth chamber through the second and/or third outlet valve. In a possible embodiment of the vacuum pump, an inflow of the gaseous medium from above into the second chamber of the connecting part and an outflow downwards from the fourth chamber can be given.

In addition, a tier-like arrangement one above the other can be provided in the connecting part when viewed in the inlet flow direction, wherein the outlet filter is arranged in a first tier, the inlet filter and the first outlet valve in a second tier and the second and third outlet valves in a third tier. The fourth chamber can thus further form the third tier as a whole, whilst the second chamber can optionally be part of the second and first tiers.

In a further embodiment, the vacuum pump can have a mounting foot or several mounting feet for setting up the vacuum pump on an installation surface.

In one possible embodiment, these mounting feet can be formed partly on the motor housing and partly on the pump housing. Alternatively, it can also be provided, particularly in the case of a vertical orientation of the vacuum pump as a whole, that the mounting feet (alone) are formed on the pump housing.

BRIEF DESCRIPTION OF THE DRAWINGS

The invention is explained hereinafter with reference to the accompanying drawing, which only depicts exemplary embodiments. A part that is only explained in relation to one of the exemplary embodiments and is not replaced by another part in a further exemplary embodiment due to the special feature highlighted there is therefore also described as a possible existing part for this further exemplary embodiment. The drawing shows.

DESCRIPTION OF THE EMBODIMENTS

Figure 1:
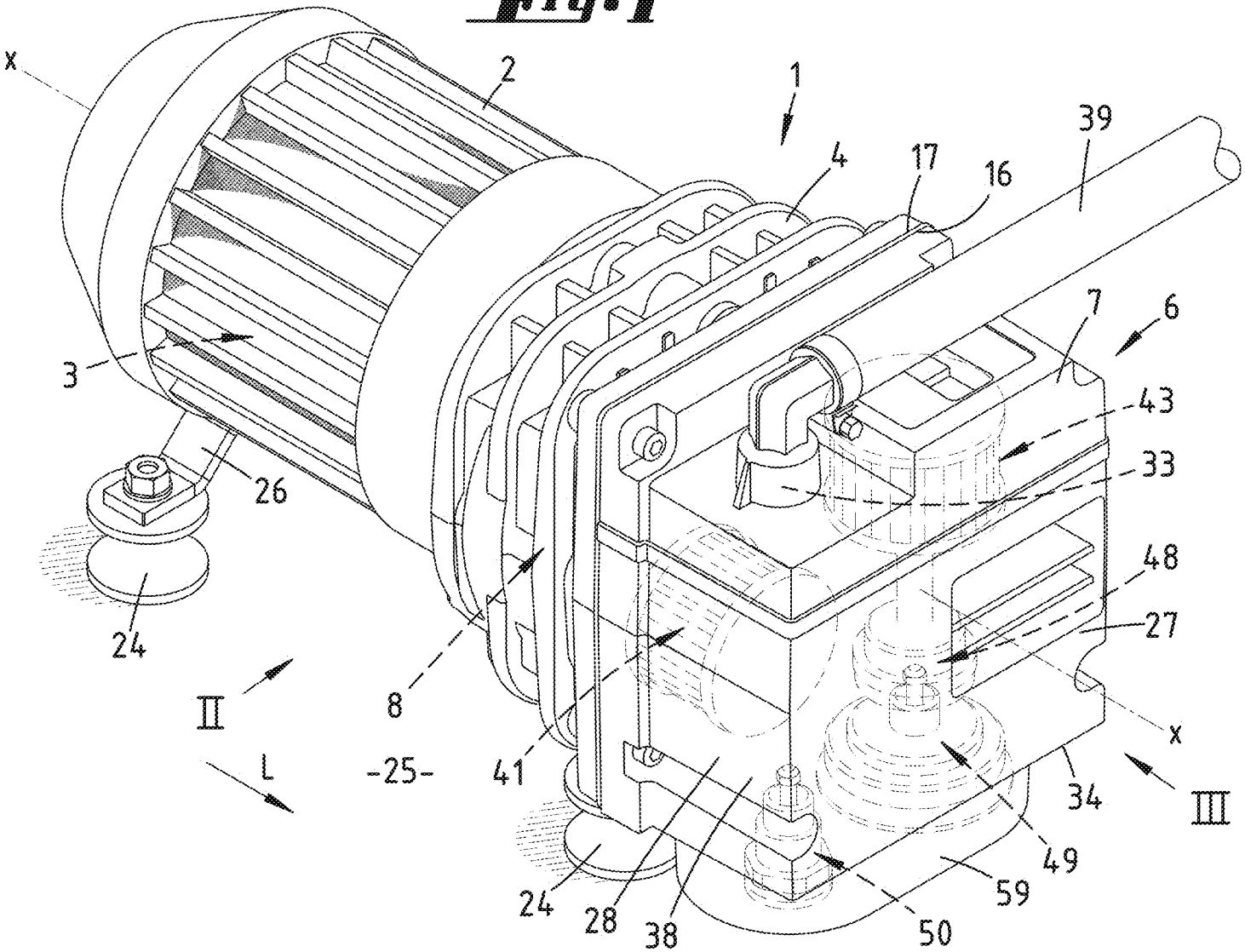
FIG. 1 shows a vacuum pump in a perspective view, relating to a first embodiment.

Shown and described, firstly with reference to FIG. 1, is a vacuum pump 1 for generating a negative pressure, which is substantially composed of a motor 3 with a motor housing 2, a pump 8 with a pump housing 4 and a pump chamber 5 (see FIG. 4). and a connecting part 6 with a connecting part housing 7.

Figure 2:
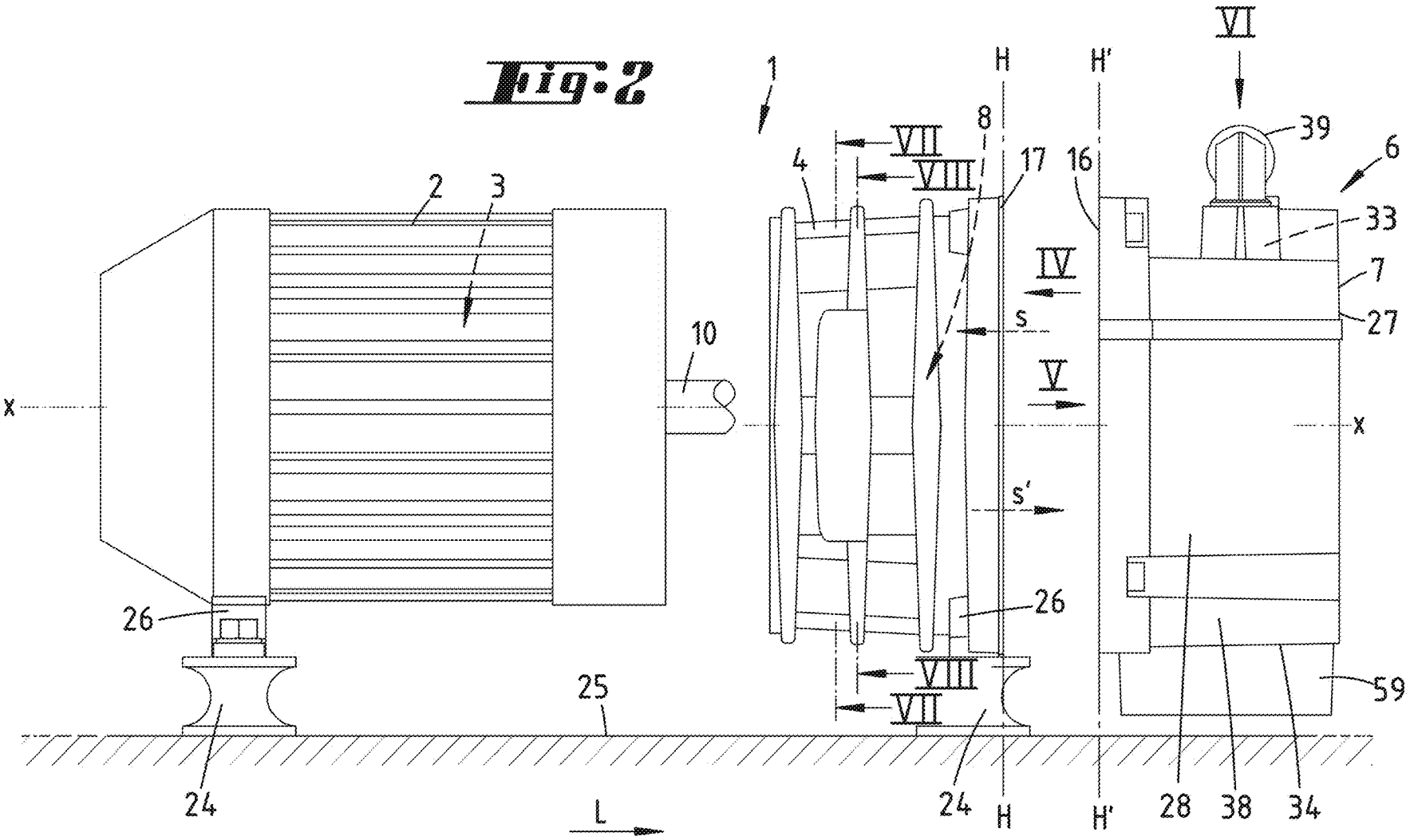
FIG. 2 shows the vacuum pump in a side view according to arrow II in FIG. 1, with an isolated representation of a motor with a motor housing, a pump with a pump housing and a connecting part with a connecting part housing.
Figure 3:
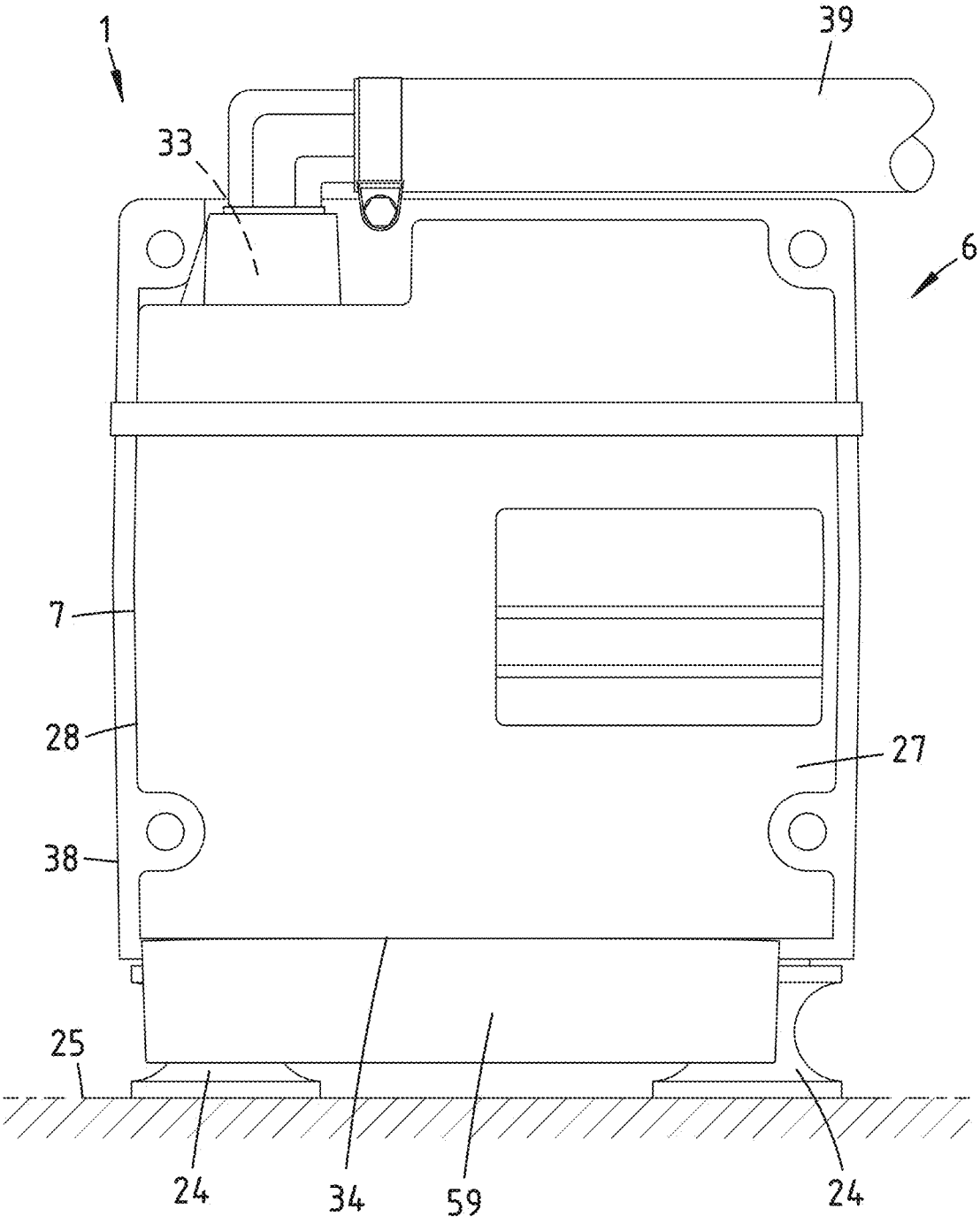
FIG. 3 shows the view towards the vacuum pump according to arrow III in FIG. 1.
Figure 4:
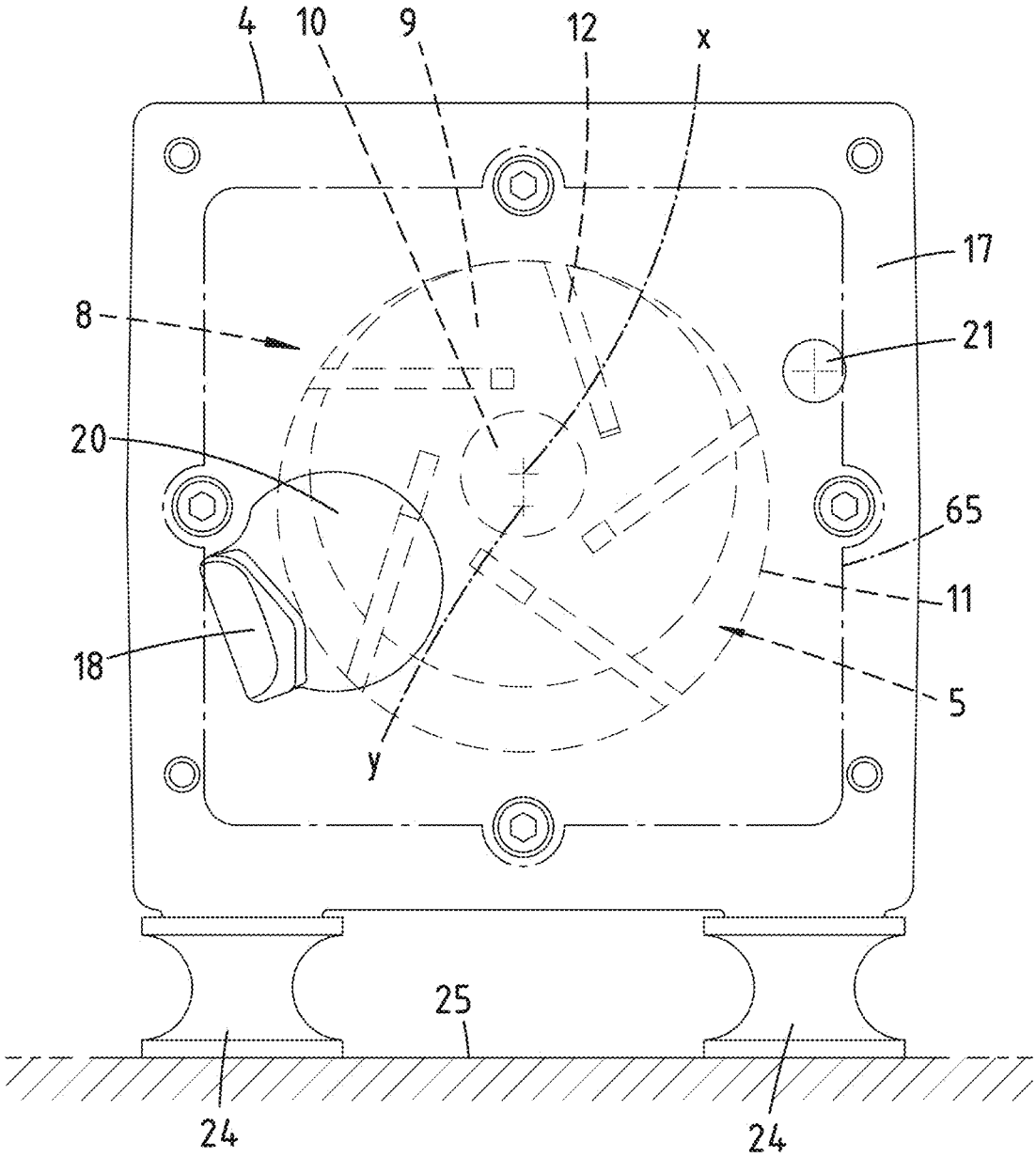
FIG. 4 shows the view towards a connecting surface of the pump housing according to arrow IV in FIG. 2.

The motor 3 can in particular be an electric motor for driving a drive shaft 10 which can be rotated about a longitudinal axis x (see FIGS. 2 and 4). The motor 3, the pump 8 and the connecting part 6 can, as is further preferred, be arranged one behind the other when viewed in the direction of the longitudinal axis x and, for example, connected to one another via screw connections. The pump 8 is preferably positioned between the motor 3 and the connecting part 6.

FIGS. 1 to 11 show a first embodiment of the vacuum pump 1, in which the previously described components (motor 3, pump 8 and connecting part 6) are provided in a substantially horizontal side-by-side arrangement relative to a usage state. This results in a horizontal arrangement direction L.

Figure 12:
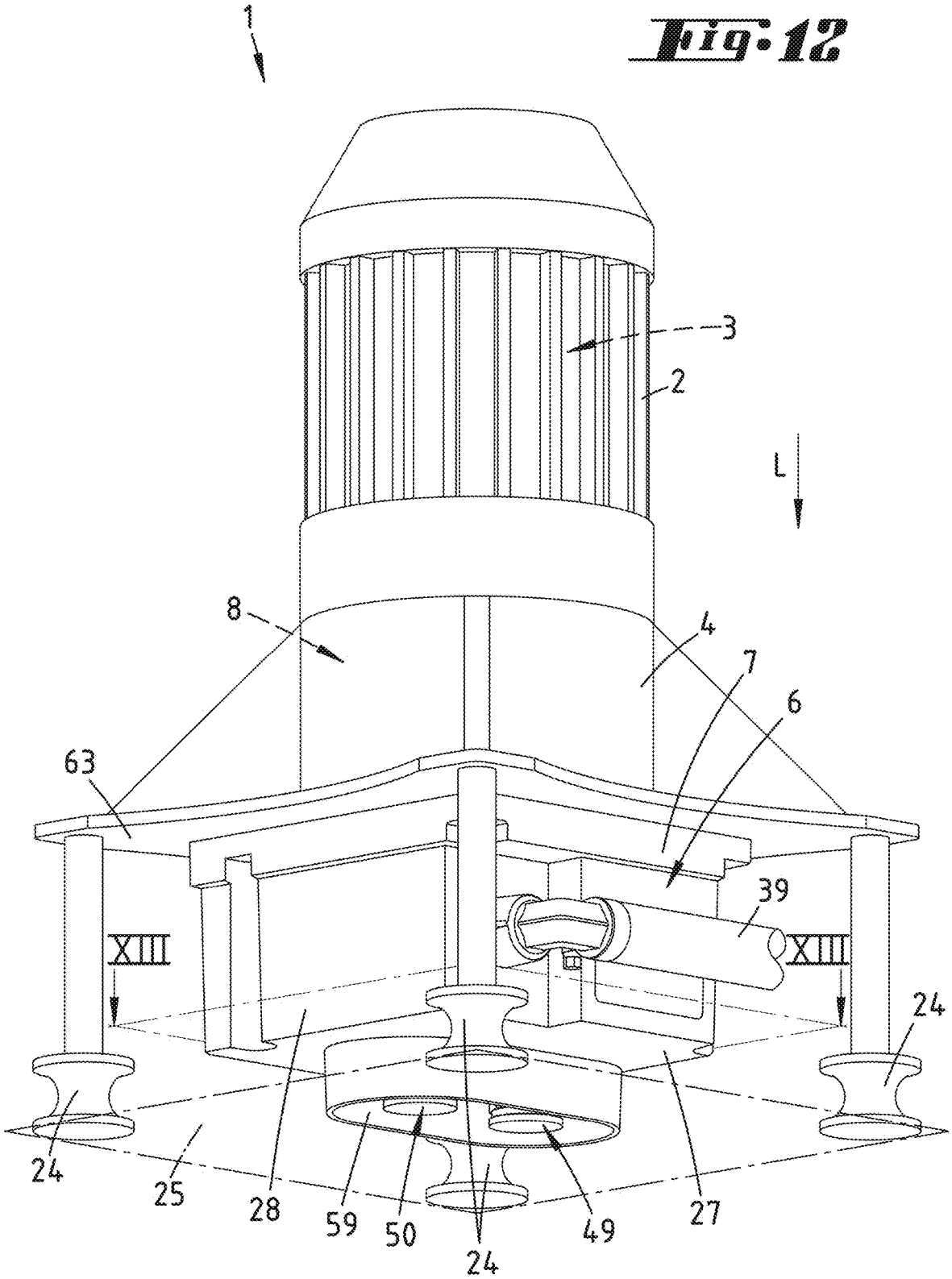
FIG. 12 shows the vacuum pump in a perspective view, relating to a second embodiment.
Figure 13:
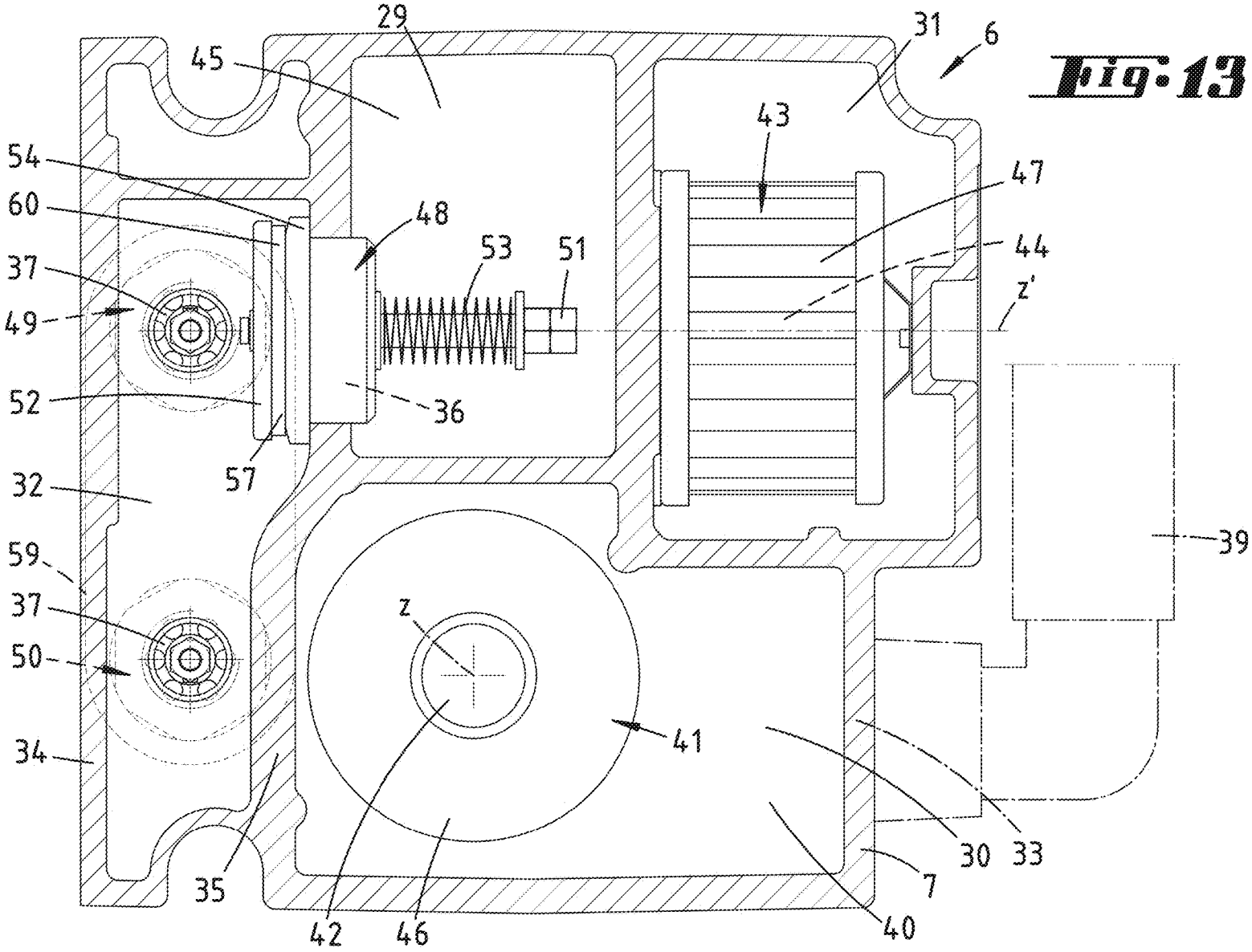
FIG. 13 shows the section through the attachment of the second embodiment along line XIII-XIII in FIG. 12.

FIGS. 12 and 13 show an alternative embodiment of the vacuum pump 1, in which the components are arranged one above the other in a vertical arrangement direction L, so that in the usage state the pump 8 is arranged vertically below the motor 3 and the connecting part 6 is arranged vertically below the pump 8.

In the exemplary embodiments shown, the pump 8 is configured in each case in the form of a rotary vane pump, with the pump chamber 5 forming a rotary vane space, in which a rotor 9 rotatable about the longitudinal axis x is arranged in the form of a rotary vane rotor. With regard to the configuration and mode of operation of the pump 8, reference is made to the literature cited initially, for example U.S. Pat. No. 5,100,308 A. The content of this patent application is hereby fully incorporated into the disclosure of the present invention, also for the purpose of including features of this patent application in the claims of the present invention.

When the pump 8 is in operation, the rotor 9, driven by a drive shaft 10, rotates about the longitudinal axis x. The track 11 of the pump chamber 5, which runs around the longitudinal axis x, is configured to be eccentric with respect to the longitudinal axis x, with a chamber diameter that exceeds the rotor diameter.

Figure 7:
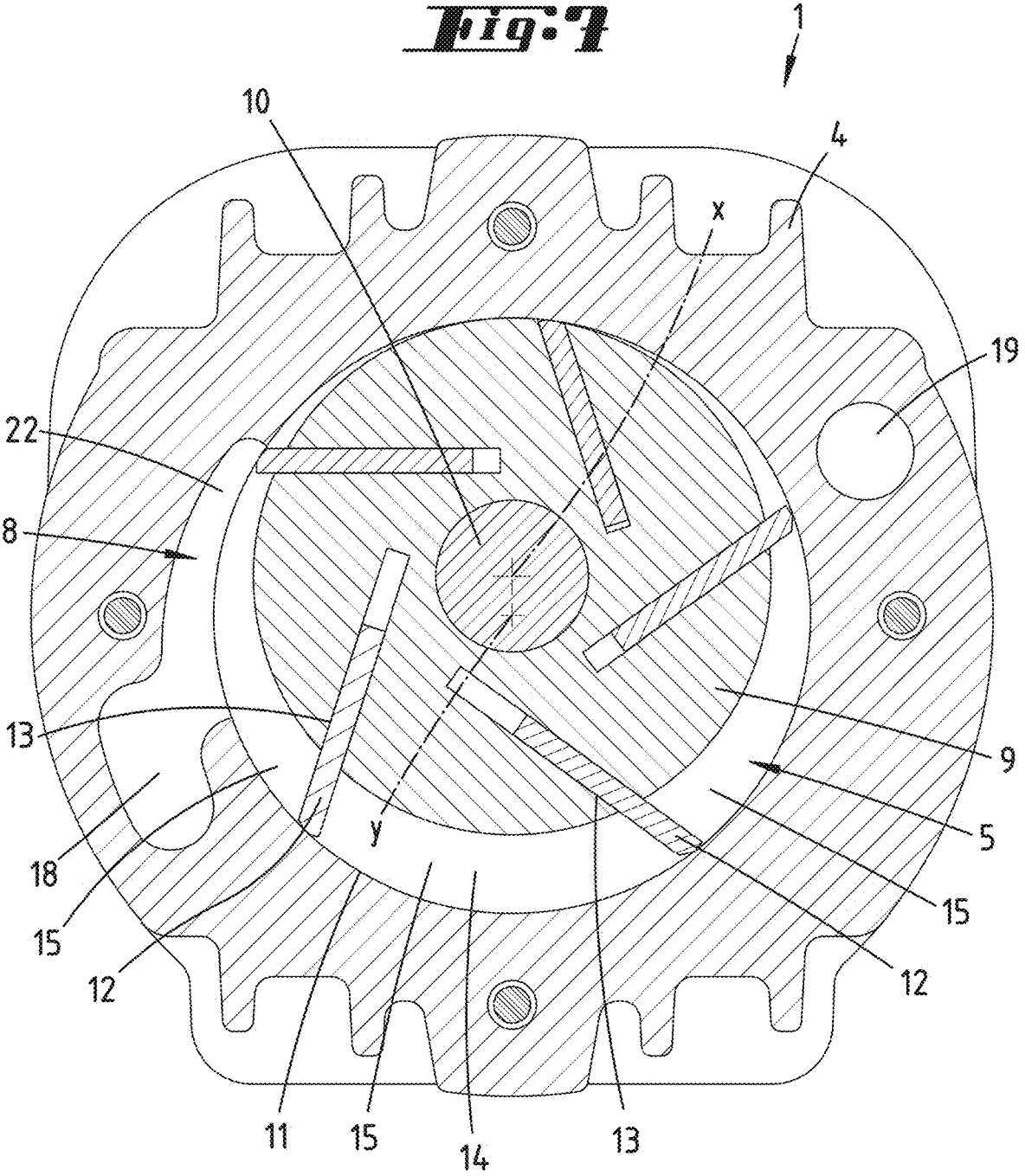
FIG. 7 shows the section along line VII-VII in FIG. 2 through the pump.
Figure 8:
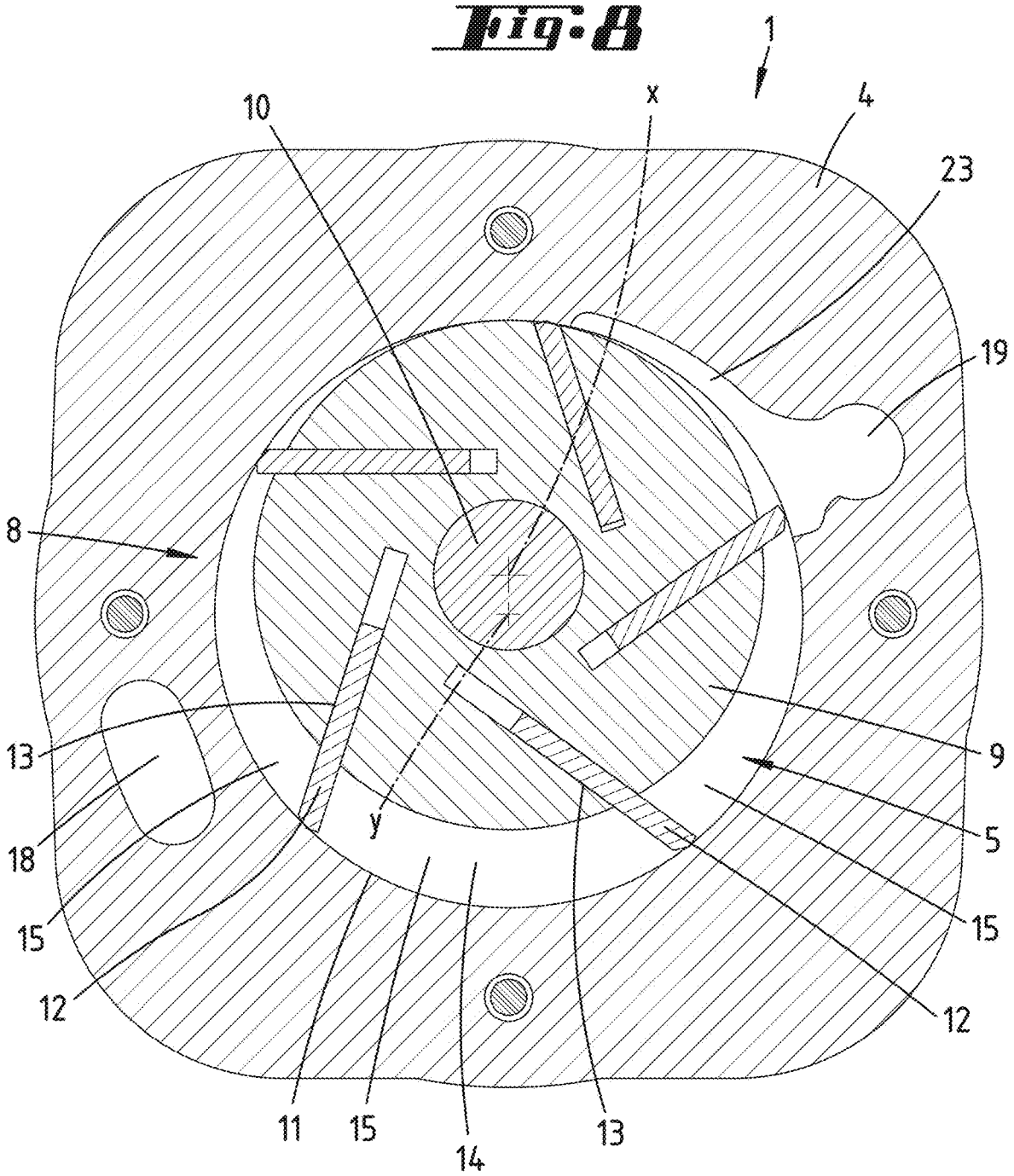
FIG. 8 shows the section along line VIII-VIII in FIG. 2 through the pump.

As can be seen in particular from FIGS. 7 and 8, the rotor 9 has sliders 12, in the exemplary embodiment shown five sliders 12, which are movably received in slots 13 directed substantially radially outwards. The sliders 12 can seal against the track 11 of the pump chamber 5 with their free slider ends due to the rotation of the rotor 9 as a result of centrifugal force.

The rotor 9 leaves a crescent-shaped compressor chamber 14 in the pump chamber 5 due to the concentric arrangement and configuration of the rotor 9 and pump chamber 5.

During operation of the vacuum pump 1, the rotor 9 rotates in a radially offset manner with respect to a geometric pump chamber axis y. This results in closed chambers 15, separated by the radially displaceable sliders 12, the size of which changes during rotation of the rotor 9.

The pump chamber 5 is closed at each end with respect to the longitudinal axis x. This can be achieved by a corresponding configuration of the pump housing 4 itself. A pump chamber end wall can thus be formed by a housing wall which runs substantially transversely to the longitudinal axis x which furthermore forms a connecting surface 17 (see FIGS. 2 and 4) facing away from the pump chamber 5 for the connecting part housing 7. In the arrangement position, the connecting surface 17 preferably cooperates in a sealing manner with a facing mating connecting surface 16 of the connecting part housing 7.

The pump chamber 5 is in fluidic communication with a (second) inlet line 18 and a (first) outlet line 19. This (second) inlet line 18 and (first) outlet line 19 preferably extend exclusively within the pump housing 4, regardless of the ultimately resulting flow direction-starting from the connecting surface 17, in which the first and second connecting openings 20 and 21 for the first outlet line 19 or the second inlet line 18 are formed, substantially initially running in a parallel orientation to the longitudinal axis x. The respective line opens radially in-wards via an extension region 22 or 23 extending in the circumferential direction of the pump chamber 5 in order to create a fluidic connection to the pump chamber 5 or to the compressor chamber 14, opening into the track 11 of the pump chamber 5.

This results in preferably two interfaces in the area of the connecting surface 17, formed by the connecting openings 20 and 21, via which, in the usual usage position of the vacuum pump 1, line sections in the form of a first inlet line 40 and a second outlet line 45 in the connecting part housing 7 are in fluidic communication with the other line sections in the form of the second inlet line 18 and the first outlet line 19 in the pump housing 4.

This preferably results in substantially two-part inlet and outlet lines arranged one after the other in the flow direction r, a part of which extends in the connecting part housing 7 on one side of the connecting surface 17 formed between the connecting part housing 7 and the pump housing 4 (first inlet line 40 and second outlet line 45) and the other part (second inlet line 18 and first outlet line 19) on the other side of the connecting surface (17) in the pump housing 4.

The connecting surface 17, which preferably has the two connecting openings 20 and 21 for the inlet and outlet lines 40, 18 and 19 and 45, can be formed in a connecting plane H oriented transversely to the longitudinal axis x (see FIG. 2).

In the usage position of the vacuum pump 1, the connecting surface 17 and the mating connecting surface 16 abut preferably and substantially flat against each other over the entire surface. A seal 65 can also be provided between these connecting and mating connecting surfaces 17 and 16, completely or only partially, but preferably circumferentially with respect to the longitudinal axis x. In FIG. 4, such a seal 65 is shown as an example only schematically as a dash-dotted line.

The vacuum pump 1 can be supported on an installation surface 25 via several mounting feet 24. According to the exemplary embodiments shown, four mounting feet 24 are provided.

In the case of a horizontal usage alignment of the components of the vacuum pump 1, two vibration-damped mounting feet 24 are preferably provided on the outside of the motor housing 2 via appropriately configured and positioned side arms 26 and two mounting feet 24 are provided on the outside of the pump housing 4 (see FIG. 1).

If a vertical usage alignment of the components of the vacuum pump 1 according to the diagram in FIG. 12 is preferred, all four mounting feet 24 can be arranged on a support frame 63 preferably only connected to the pump housing 4, which support frame 63 overlaps the connecting part housing 7 in a stilt-like manner so that the connecting part 6 is arranged vertically below the pump 8, in a quasi-freely suspended manner.

A support of the vacuum pump 1 on the installation surface 25 (partially) via the connecting part housing 7 is preferably not provided.

The connecting part housing 7 preferably has an end wall 27 which runs substantially parallel to the mating connecting surface 16 and is approximately rectangular in outline, from which side walls 28 extend up to the mating connecting surface 16 which run substantially perpendicular to the orientation of the end wall 27.

The result is a box-shaped design of the connecting part housing 7, preferably open to the mating connecting surface 16.

The interior of the connecting part housing 7, delimited by the end wall 27 and the side walls 28, is preferably divided into several chambers by forming corresponding partition walls 64, thus preferably into a first chamber 29, a second chamber 30, a third chamber 31 and a fourth chamber 32. The partition walls 64 can, as is also preferred, be formed in one piece and made of the same material as the connecting part housing 7 as a whole.

The end faces of the side walls 28 facing away from the end wall 27 and the partition walls 64 dividing the chambers 29, 30, 31 and 32 can form the mating connecting surface 28 as a whole.

Figure 5:
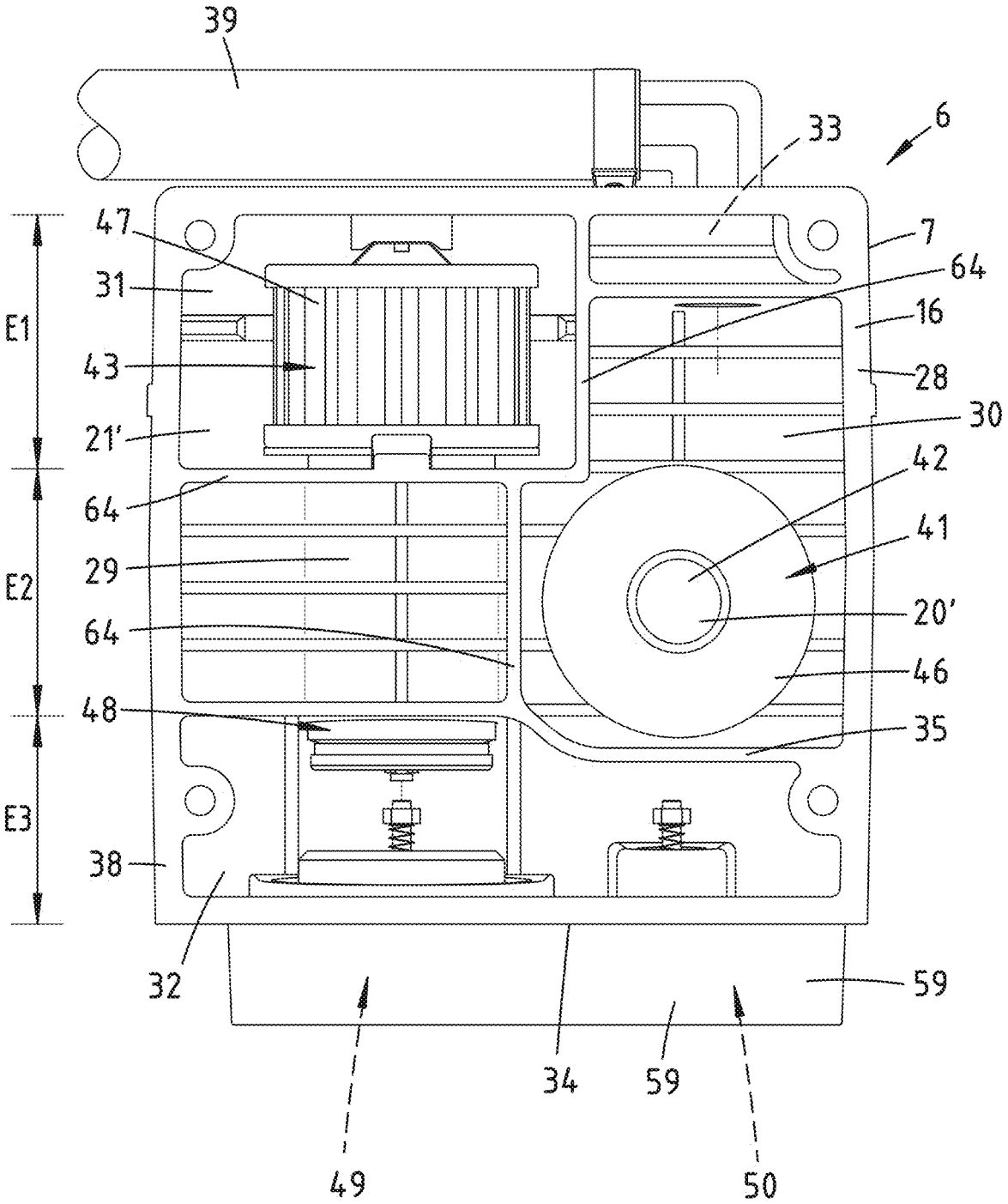
FIG. 5 shows the view towards a mating connecting surface of the connecting part housing according to arrow V in FIG. 2.
Figure 6:
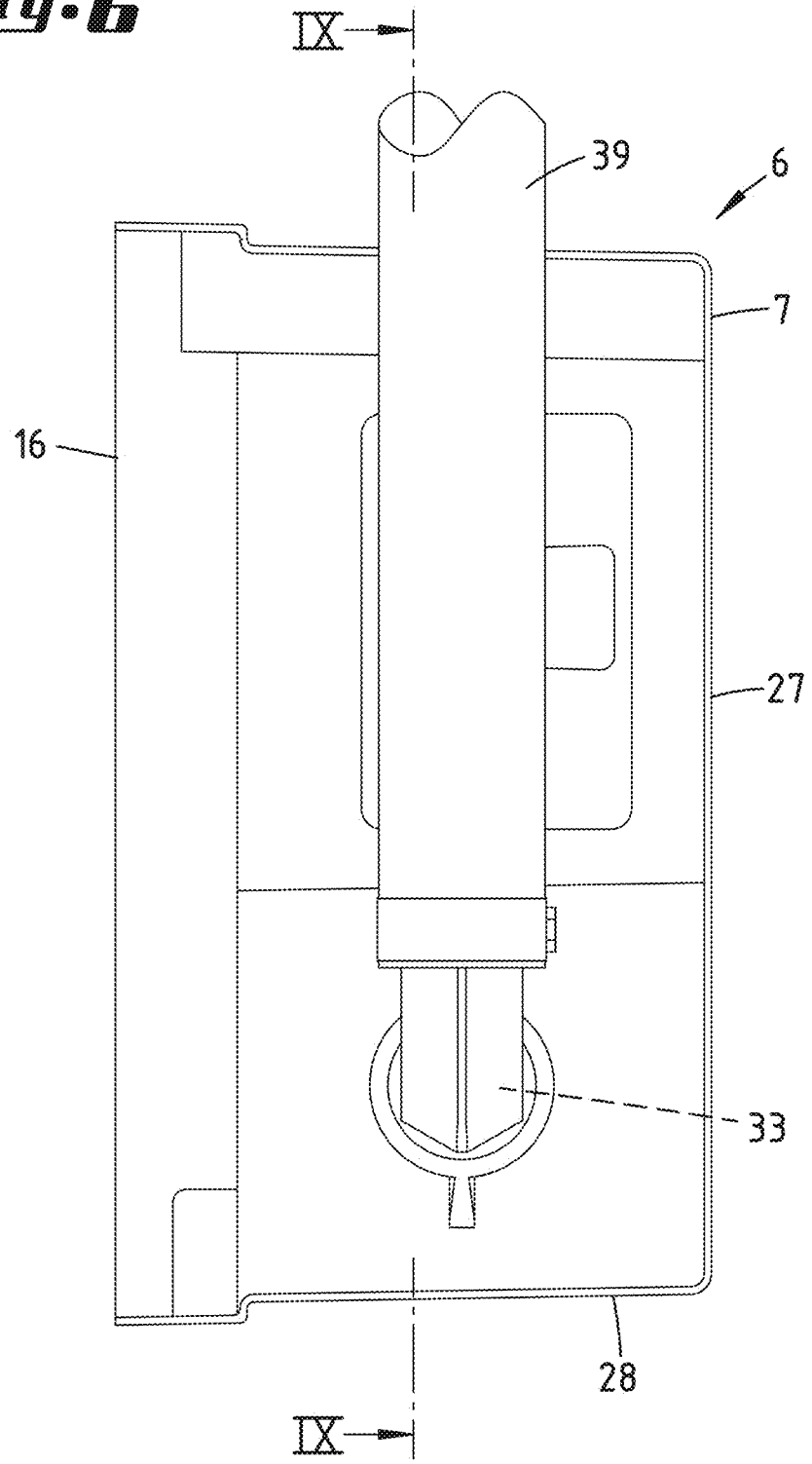
FIG. 6 shows the top view of the connecting part according to arrow VI in FIG. 2.

The chambers 29 to 32 are formed in tiers E1, E2 and E3 arranged one above the other (see FIG. 5). The third chamber 31 can thus be formed in an upper tier E1 and a sub-section of the second chamber 30 can be formed in a side-by-side arrangement but fluidly separated from this by a partition wall 64.

In the second, middle tier E2, the first chamber 29 and the further sub-section of the second chamber 30 can be provided below the third chamber 31, wherein here also an arrangement is preferably given next to one another and fluidically separated by a partition wall 64.

Ultimately, in the exemplary embodiment shown, the third tier E3 can comprise or form the fourth chamber 32, which fourth chamber 32 can preferably extend over the entire third tier E3 and preferably overlaps the first chamber 29 formed in the second tier E2 and the adjacent sub-section of the second chamber 30 or in overlap with the third chamber 31 formed in the first tier E1 and the adjacent sub-section of the second chamber 30.

With regard to the configuration of the connecting part housing 7 alone, it is provided that—in relation to a plane of intersection given substantially parallel to the mating connecting surface 16—the first chamber 29 opens both towards the third chamber 31 and towards the fourth chamber 32, whereas the second chamber 30 has only one inlet opening 33 in an associated section of the side wall 28 for an inflowing gaseous medium.

The fourth chamber 32 furthermore has two outlet openings 37 formed in a side wall 28, which optionally forms the chamber floor 34, which preferably can be directed downwards towards the installation surface 25 regardless of the arrangement direction L of the vacuum pump 1 (horizontal or vertical orientation according to FIG. 1 or 12).

The chamber ceiling 35 of the fourth chamber 32 forms the separation from the first and second chambers 29 and 30 arranged thereabove, wherein the valve-closable opening 36 from the first chamber 29—as described in more de-tail hereinafter—is also provided in this chamber ceiling 35.

The resulting chamber side wall 38 is preferably formed directly by the side wall 28 of the connecting part housing 7 and—with reference to the arrangement and usage position—extends in a circumferentially closed manner, incorporating the connecting surface 17 of the pump housing 4.

An inlet filter 43 is preferably accommodated in the second chamber 30. The second chamber 30 at the same time also forms at least part of a first inlet line 40. The first inlet line 40 preferably also includes a supply line 39, which opens into the second chamber 30. The first inlet line 40 is correspondingly formed on or in the connecting part 6. During operation, gaseous medium can flow into the pump chamber 5 through the first inlet line 40. The inlet filter 41 can comprise a barrel-shaped filter cartridge with a circumferential filter wall 46 and a central filter axis z. The medium can flow through this inlet filter 41 from radially outside to radially inside and leaves on the inside a flow path 42 for filtered gaseous medium running in the direction of the filter axis z. This flow path 42 preferably opens into the mating connection plane H' of the mating connecting surface 16 and forms the first connecting opening 20' on the connecting part side in this mating connection plane H', for the fluidic connection to the second inlet line 18 within the pump housing 7.

Furthermore, an outlet filter 43, preferably also configured in the manner of a filter cartridge, is provided in the third chamber 31, through which gaseous medium discharged from the pump housing 4 can also flow in the area of a circumferential filter wall 47 from radially outside to radially inside and leaves a flow path 44 on the inside with a filter axis z'.

The filter axes z and z' of the inlet filter 41 and the outlet filter 43 are aligned perpendicular to one another, wherein further preferably the filter axis z' of the outlet filter 43 can run substantially in the inlet flow direction $r_E$.

The inner flow path 44 of the outlet filter 43 preferably opens directly into the first chamber 29, which together with the third and fourth chambers 31 and 32 substantially form the second outlet line 45 within the connecting part housing 7, for fluidic connection to the first outlet line 19 within the pump housing 7.

In the first chamber 29 adjoining the inner flow path 44 of the outlet filter 43, a first outlet valve 48 is arranged in the transition to the fourth chamber 32. This can, as is also preferred, be constructed substantially the same as a further second outlet valve 49 and a third outlet valve 50, which second and third outlet valves 49 and 50 can be arranged in the area of the outlet openings 37 provided in the fourth chamber 32.

The outlet valves 49 and 50 preferably form outlet valves for the exit of the conveyed gaseous medium into the environment.

Figure 9:
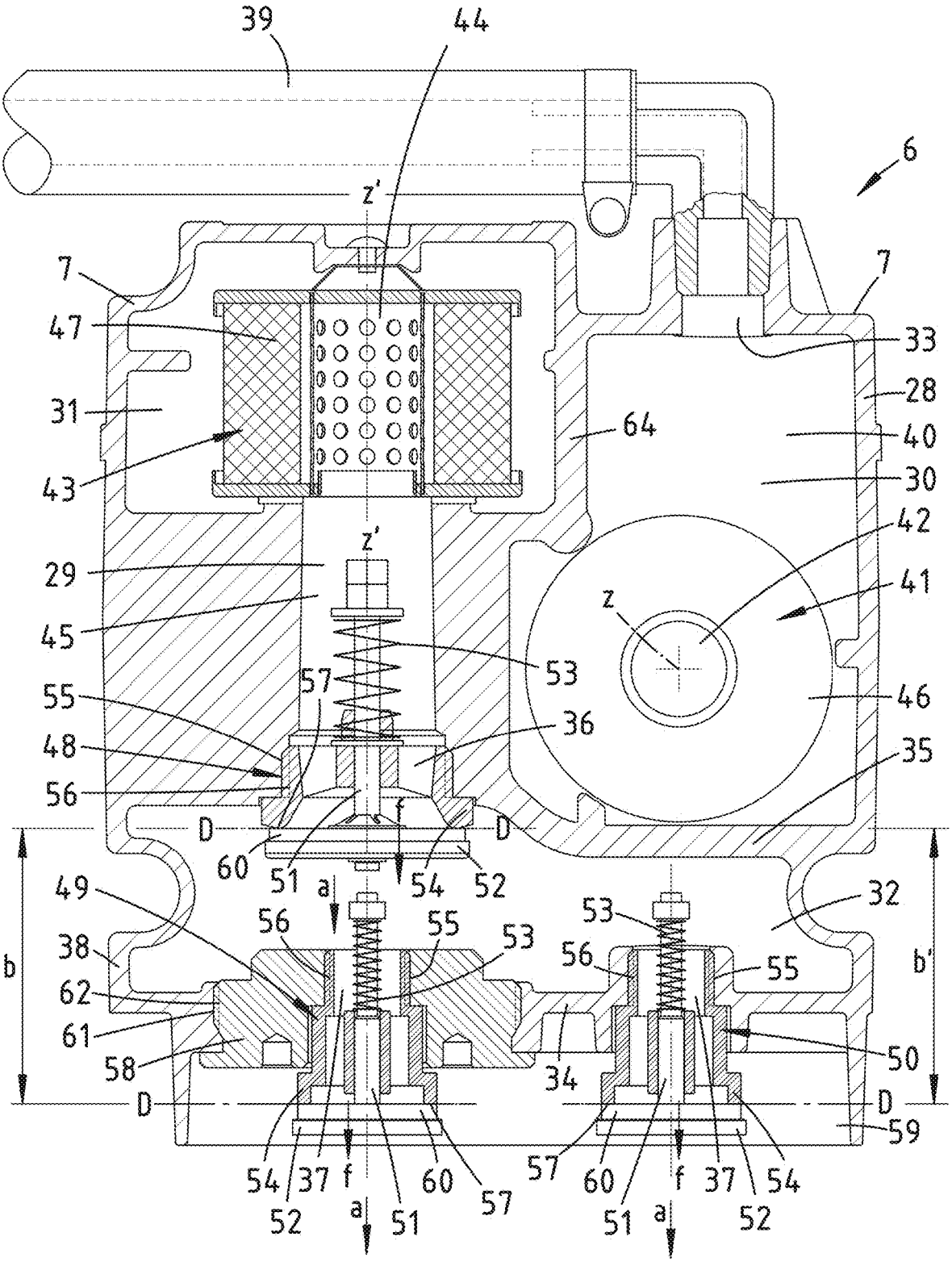
FIG. 9 shows the section along the line IX-IX in FIG. 6 through the connecting part, relating to a valve closed position.
Figure 10:
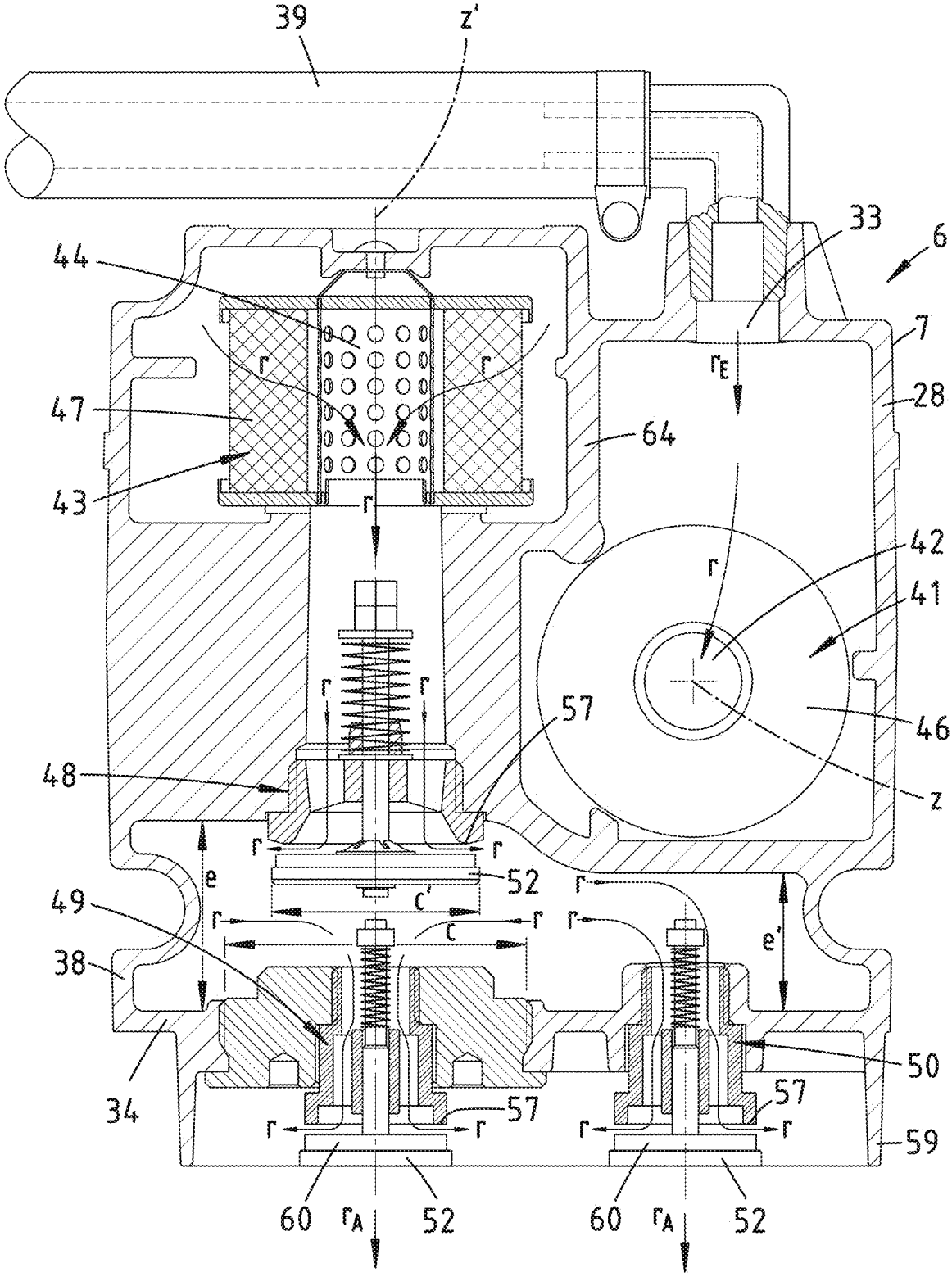
FIG. 10 shows a sectional view corresponding to FIG. 9, relating to a valve open position.
Figure 11:
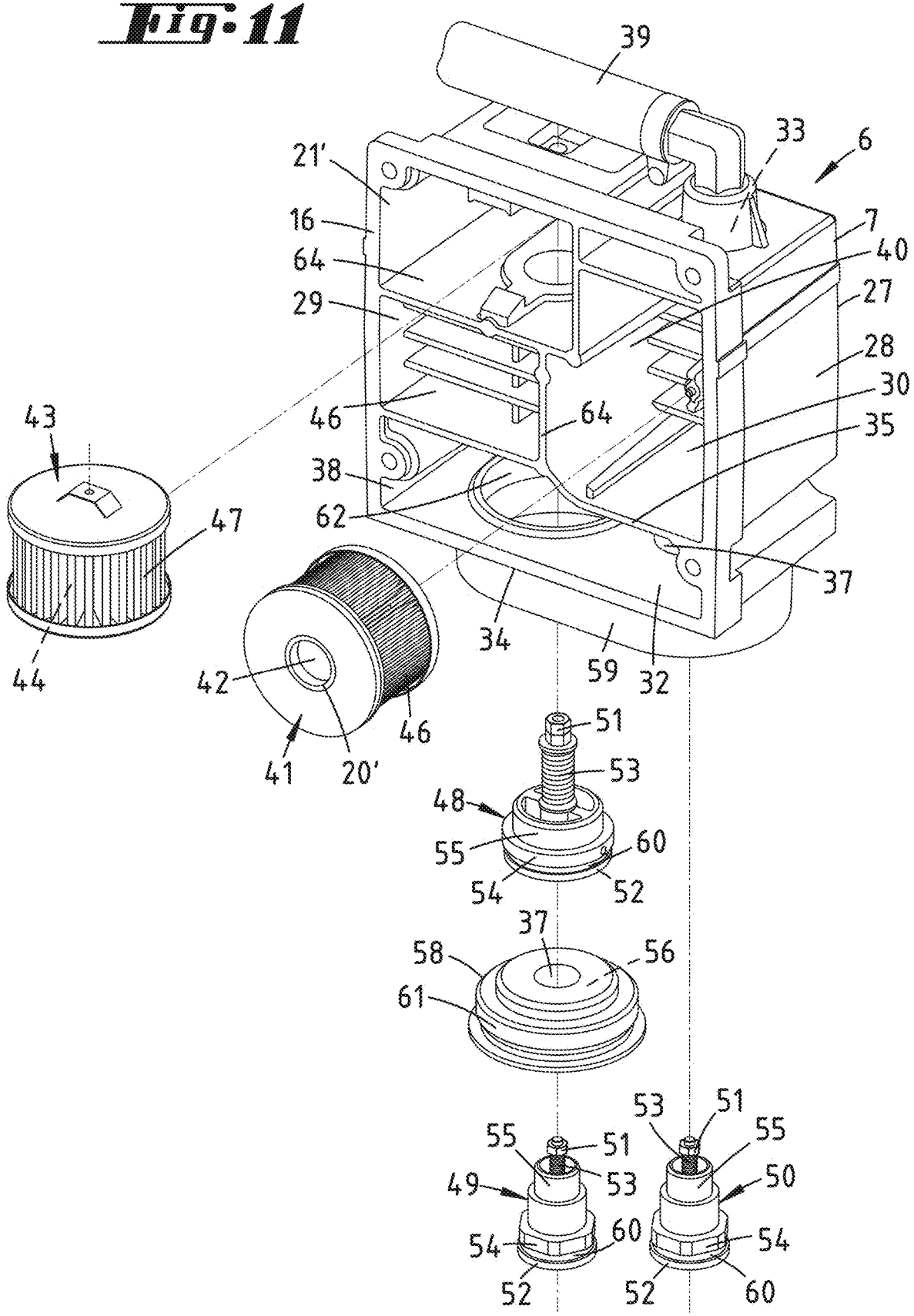
FIG. 11 shows the connecting part in a perspective exploded view.

All the outlet valves 48 to 50 can be controlled depending on the pressure between a valve closed position, which corresponds to the basic position shown, for example, in FIG. 9, and a valve open position (see FIG. 10).

Each outlet valve 48 to 50 has a valve plate 52 with a sealing layer 60, which is provided with a valve tappet 51 that can be moved linearly in an opening direction a. The opening direction a is preferably obtained in the alignment with the filter axis z' of the outlet filter 43, wherein the opening direction a further defines the idealized, linear flow direction f through the respective outlet valve.

The unit consisting of valve tappet 51 and valve plate 52 is supported on a valve base 54 via a spring 53 acting in the direction of a valve closure position, in the exemplary embodiment shown, a cylinder compression spring, which cooperates via an external thread 55 with an internal thread 56 on the housing side. This accordingly results in a screw fastening of the respective outlet valve 48, 49, 50 directly or indirectly to the connecting part housing 7.

The valve base 54 forms a valve seat 57 for sealing cooperation with the valve plate 52.

As can be seen from the illustrations, the first outlet valve 48 and the second outlet valve 49 can overlap one another when viewed in the opening direction a of the first outlet valve 48. The resulting distance b between the sealing planes D of the first outlet valve 48 and the second outlet valve 49 in the opening direction a preferably corresponds to the distance b' between the sealing planes D of the first outlet valve 48 and the third outlet valve 50 when viewed in the opening direction a (see FIG. 9).

In the exemplary embodiments shown, both the first outlet valve 48 and the third outlet valve 50 are screw-fastened directly with or in the connecting part housing 7. An internal thread 56 of the screw fastening is correspondingly formed directly in the outlet opening 37 or in the opening 36 of the chamber ceiling 35 between the first chamber 29 and the fourth chamber 32.

However, according to a possible embodiment, the second outlet valve 49, which is preferably arranged in axial overlap with the first outlet valve 48, can only be connected to the connecting part housing 7 indirectly via an installation part 58. The installation part 58 can be a screw-in part, with an external thread 61, which cooperates with an internal thread 62 of the connecting part housing 7. The second outlet valve 49 cooperates with its external thread 55 in accordance with the other outlet valves with an internal thread 56 formed in the installation part 58 (see FIG. 9).

The installation part 58 or the opening obtained in the chamber floor 34 of the attachment part housing 7 for receiving the installation part has a width c when viewed perpendicular to the opening direction a, which preferably exceeds the width c' of the first outlet valve 48 viewed in the same direction by at least for example about 1.1 to, for example, about 1.5 times.

Due to the screw fastening of the outlet valves, they can be removed from the attachment part housing 7 in the opening direction a, for example for maintenance purposes. After removal of the installation part 58, the first outlet valve 48 is also exposed for removal through the enlarged opening then formed in the chamber floor 34.

With regard to the fourth chamber 32, a non-uniform extension can be obtained when viewed in a transverse direction to the opening direction a of the outlet valves 48 to 50. Thus, as shown, the relevant chamber ceiling 35 in a section accommodating the first outlet valve 48 and closing the first chamber 29 can have a greater height e to the chamber floor 34, when viewed in the opening direction a, than in the adjoining final section of the chamber ceiling 35 (see FIG. 9) terminating second chamber 30 to the fourth chamber 32. The height e' in this lower area assigned to the third outlet valve 50 can, for example, be approximately 0.6 to 0.9 times, further for example approximately 0.75 times the height e.

If an arrangement direction L aligned substantially on a horizontal according to the embodiment shown in FIGS. 1 to 11 is provided, an outlet flow direction $r_A$ of the conveyed gaseous medium from the fourth chamber 32 and through the second and/or third outlet valve 49, 50 is preferred substantially in the same direction as the inlet flow direction re into the second chamber 30 (see FIG. 10).

With such a horizontal arrangement direction L, the flow directions f through all three outlet valves 48, 49 and 50 can be in the same direction but spatially offset (compare FIGS. 9 and 10).

If, on the other hand, an arrangement direction L oriented on a vertical is preferred, this preferably results in a differently oriented outflow direction $r_A$, in particular an outlet flow direction $r_A$ oriented perpendicular to the inlet flow direction $r_E$. In this case, a section of the chamber side wall 38 forms a chamber floor, whilst the housing wall sections referred to as the chamber floor 34 and the chamber ceiling 33 rather form side walls of the fourth chamber 32.

With a vertical arrangement direction L, a flow direction f in the same direction with respect to the second and third outlet valves 49 and 50, but perpendicular to the first outlet valve 48 is obtained.

Accordingly, in the course of passing through the second and/or third outlet valve 49, 50, a deflection of the gaseous medium by substantially 90 degrees can be obtained in the fourth chamber 32, in order to be able to achieve an outlet flow direction $r_A$ directed downwards in the direction of the installation surface 25 even with such a vertical alignment of the vacuum pump 1.

On the output side of the second and third outlet valves 49 and 50, the connecting part housing 7 can also have a collar section 59 comprising both outlet valves 49 and 50, which can have such a length in the outlet flow direction $r_A$ that the valve section protruding beyond this housing section can be overlaid even when the valve plate 52 located in the valve open position is lifted (see FIG. 10).

A connecting plane H is obtained between the pump housing 4 and the connecting part housing 7, in which the first connecting opening 20 and the second connecting opening 21 are provided on the pump side in the form of openings in the connecting surface 17, whilst on the connecting part side the corresponding first connecting opening 20' is provided, in particular through the inner flow path 42 of the inlet filter 41 which opens in the mating connecting surface 16 or the mating connecting plane H' and the second connecting opening 21' is provided by the third chamber 31 which is open towards the mating connecting plane H'.

The outlet valves 48, 49, 50 only open when a pressure exceeding the restoring force of the respective spring 53 is exceeded by lifting the valve plate 51 with its sealing layer 60 from the associated valve seat 57. The outlet valves 48, 49, 50 are preferably self-controlled by the pressure of the pump 8.

During operation of the vacuum pump 1, a flow direction r of the gaseous medium is obtained in the second chamber 29 with the inlet filter 41, the pump chamber 5, subsequently the third chamber 31 with the outlet filter 43 and—with the outlet valve open—in both the first and fourth chambers 28, 32, wherein the gaseous medium from the first outlet valve 48 in the fourth chamber 32 is optionally divided into two flow sections—with the second and third outlet valves 49 and 50 preferably open at the same time. The outlet openings 37 preferably lead the partial flows into an area below the connecting part housing 7.

If the third outlet valve 50 is possibly closed, but the second outlet valve 49 is open, the gaseous medium flows outwards through the second outlet valve 49 immediately after exiting the first outlet valve 48, substantially following the opening direction a of the first outlet valve 48.

If the second outlet valve 49 is closed, but the third outlet valve 50 is open, the gaseous medium in the fourth chamber 32 flows substantially along the chamber floor 34 past the closed second outlet valve 49 to exit to the outside via the third outlet valve 50.

As described above and as can also be seen from FIG. 5, essential components or assemblies, such as in particular the inlet filter 41, the outlet filter 43 and the outlet valves 48, 49, and 50—viewed in the flow direction r—are formed or arranged outside or upstream and downstream of the pump chamber 5 in the connecting part 6. This advantageously results in a modular structure, which, for example, enables these components to be easily changed by replacing the connecting part 6 as a whole.

Both a medium inlet into the first inlet line 40 and a medium outlet from the second outlet line 45 of the vacuum pump 1 as a whole are laid in the connecting part housing 7, wherein during operation of the vacuum pump 1 the connecting plane H obtained between the connecting surface 17 and the mating connecting surface 16 is penetrated twice and in opposite directions by the gaseous medium (see arrows s and s' in FIG. 2).

| Reference list | |
|---|---|
| 1 | Vacuum pump |
| 2 | Motor housing |
| 3 | Motor |
| 4 | Pump housing |
| 5 | Pump chamber |
| 6 | Connecting part |
| 7 | Connecting part housing |
| 8 | Pump |
| 9 | Rotor |
| 10 | Drive shaft |
| 11 | Track |
| 12 | Slider |
| 13 | Slot |
| 14 | Compressor chamber |
| 15 | Chamber |
| 16 | Mating connecting surface |
| 17 | Connecting surface |
| 18 | Second inlet line |
| 19 | First outlet line |
| 20 | first connecting opening |
| 20 | First connecting opening |
| 21 | Second connecting opening |
| 21' | Second connecting opening |
| 22 | Extension region |
| 23 | Extension region |
| 24 | Mounting foot |
| 25 | Installation surface |
| 26 | Side arm |
| 27 | End wall |
| 28 | Side wall |
| 29 | First chamber |
| 30 | Second chamber |
| 31 | Third chamber |
| 32 | Fourth chamber |
| 33 | Inlet opening |
| 34 | Chamber floor |
| 35 | Chamber ceiling |
| 36 | Opening |
| 37 | Outlet opening |
| 38 | Chamber side wall |
| 39 | Supply line |
| 40 | First inlet line |
| 41 | Inlet filters |
| 42 | Flow path |
| 43 | Outlet filter |
| 44 | Flow path |
| 45 | Second outlet line |
| 46 | Filter wall |

-continued

| Reference list | |
|---|---|
| 47 | Filter wall |
| 48 | First outlet valve |
| 49 | Second outlet valve |
| 50 | Third outlet valve |
| 51 | Valve tappet |
| 52 | Valve plate |
| 53 | Spring |
| 54 | Valve base |
| 55 | External thread |
| 56 | Internal thread |
| 57 | Valve seat |
| 58 | Installation part |
| 59 | Collar section |
| 60 | Sealing layer |
| 61 | External thread |
| 62 | Internal thread |
| 63 | Support frame |
| 64 | Partition wall |
| 65 | Seal |
| a | Opening direction |
| b | Distance |
| b' | Distance |
| c | Width |
| c' | Width |
| e | Height |
| e' | Height |
| f | Flow direction |
| s | Arrow |
| s' | Arrow |
| x | Longitudinal axis |
| y | Pump chamber axis |
| Z | Filter axis |
| z' | Filter axis |
| r | Flow direction |
| $r_E$ | Inlet flow direction |
| $r_A$ | Outlet flow direction |
| D | Sealing plane |
| E1 | First tier |
| E2 | Second tier |
| E3 | Third tier |
| H | Connecting plane |
| H' | Mating connecting plane |
| L | Arrangement direction |

The invention claimed is:

1. A vacuum pump (1) for generating a negative pressure, comprising:

a pump housing (4) having a pump chamber (5) with a rotor (9) and a motor (3) for driving the rotor (9) by means of a drive shaft (10) rotatable about a longitudinal axis (x), a first and a second inlet line (40, 18), wherein the second inlet line (18) as a continuation of the first inlet line (40) leads through the pump housing (4) into the pump chamber (5), a first outlet line (19) leading from the pump chamber (5) through the pump housing (4), a first outlet valve (48), a second outlet line (45) adjoining the pump housing (4), wherein on the pump housing (4) a connecting part (6) with a connecting part housing (7) is attached to a connecting surface (17) running circumferentially to the longitudinal axis (x) and the first outlet valve (48) with the second outlet line (45) is formed in the connecting part (6), wherein the connecting part (6) further comprises the first inlet line (40), with a first connecting opening (20') formed in the connecting part (6) via which the first inlet line (40) is connected to the second inlet line (18).

2. The vacuum pump according to claim 1, wherein the second outlet line (45) is connected to the first outlet line (19) via a second connecting opening (21, 21') formed in the connecting part housing (7) and/or wherein the first outlet valve (48) is arranged in the second outlet line (45).

3. The vacuum pump according to claim 1, wherein the connecting part (6) has one or more chambers (29, 30, 31, 32) and/or wherein the first inlet line (40) has an inlet filter (41) and/or the second outlet line (45) has an outlet filter (43).

4. The vacuum pump according to claim 3, wherein the first outlet valve (48) is arranged in a first chamber (29) of the connecting part housing (7) and/or wherein the inlet filter (41) is arranged in a second chamber (30) of the connecting part housing (7) and/or wherein the outlet filter (43) is arranged in a third chamber (31) of the connecting part housing (7).

5. The vacuum pump according to claim 1, wherein the connecting surface (17) runs perpendicular to the longitudinal axis (x) and/or wherein the connecting part (6) has a mating connecting surface (16) which is oriented in the same direction as the connecting surface (17), and/or wherein the first and/or the second connecting opening (19', 20') is formed in the mating connecting surface (16).

6. The vacuum pump according to claim 1, wherein the inlet filter (41) and/or the outlet filter (43) has a circumferential filter wall (46, 47) through which flow can take place from an outside to an inside and forms a flow path (42, 44) on the inside for filtered gas, and/or wherein the inlet filter (41) and the outlet filter (43) are arranged such that the flow paths (42, 44) of the inlet filter (41) and the outlet filter (43) run substantially at right angles to one another.

7. The vacuum pump according to claim 6, wherein in a direction of the flow path (44) of the outlet filter (43) the first outlet valve (48) adjoins said outlet filter and/or wherein a fourth chamber (32) adjoins the first outlet valve (48), which is closed to the outside by a second (49) and a third outlet valve (50).

8. The vacuum pump according to claim 7, wherein if three outlet valves (48, 49, 50) are arranged, flow can take place through all the outlet valves (48, 49, 50) in the same direction and/or wherein flow should take place through the second and third outlet valves (49, 50) downstream of the first outlet valve (48) in the flow direction (r) in a same flow direction (r) but perpendicular to a flow direction (f) of the first outlet valve (48).

9. The vacuum pump according to claim 7, wherein the fourth chamber (32) is partially formed by a wall of the connecting part housing (7), which is also a wall of the second chamber (30) for receiving the inlet filter (41).

10. The vacuum pump according to claim 7, wherein the outlet valves (48, 49, 50) have an opening direction (a) and wherein, relative to the opening direction (a) of the first outlet valve (48), the first outlet valve (48) and the second outlet valve (49) are arranged in overlap with one another, and/or wherein the second outlet valve (49) is accommodated in the connecting part (6) by means of an installation part (58), which has a larger area perpendicular to the opening direction (a) than the first outlet valve (48).

11. The vacuum pump according to claim 7, wherein the fourth chamber (32), relative to the first and optionally to the second outlet valve (49, 50), has a non-uniform extension in the transverse direction to the opening direction (a) of the first and optionally the second outlet valve (49, 50) and/or wherein the fourth chamber (32) has a chamber floor (34), a chamber ceiling (35) and a chamber side wall (38), wherein the first outlet valve (48) is arranged in the chamber ceiling (35) and the second outlet valve (49) is arranged in the chamber floor (34), and/or wherein the third outlet valve (5) is also arranged in the chamber floor (34).

12. The vacuum pump according to claim 7, wherein when the second outlet valve (49) is closed, an outlet gas flows past the second outlet valve (49) to the third outlet valve (50), with the gas being diverted along the chamber floor (34).

13. The vacuum pump according to claim 11, wherein the chamber side wall (38) extends substantially in the opening direction (a) of the first outlet valve (48) and is configured to be closed circumferentially and/or wherein the chamber side wall (38) is formed directly by the wall of the connecting part (6).

14. The vacuum pump according to claim 11, wherein the third outlet valve (50) in the opening direction (a) of the first and optionally the second outlet valve (48, 49) is located at the same distance (b') in the opening direction (a) to the first outlet valve (48) as the second outlet valve (49) to the first outlet valve (48).

15. The vacuum pump according to claim 1, wherein an inlet flow direction ($r_E$) of the gas into the second chamber (30) accommodating the inlet filter (41) is in the same direction as an outlet flow direction ($r_A$) from the fourth chamber (32) through the second and/or third outlet valve (49, 50) and/or wherein, when viewed in the inlet flow direction ($r_E$), a tier-like arrangement one above the other is provided in the connecting part (6), wherein the outlet filter (43) is arranged in a first tier (E1), the inlet filter (41) and the first outlet valve (48) are arranged in a second tier (E2) and the second and third outlet valves (49, 50) are arranged in a third tier (E3).

16. The vacuum pump (1) according to claim 1, further comprising a motor housing (2), in which a motor (3) with a drive shaft (10), which runs axially in alignment with the longitudinal axis (x) is accommodated, and a connecting part (6) with an outlet valve (48) and a second outlet line (45), wherein in a usage state, the pump housing (4) is arranged vertically below the motor housing (2) and the connecting part (6) is arranged vertically below the pump housing (4).

17. The vacuum pump according to claim 16, wherein the vacuum pump (1) has a mounting foot (24) or several mounting feet (24), and/or wherein the mounting foot (24) is formed on the pump housing (4).

* * * * *